US007846276B2

(12) United States Patent
Hasek et al.

(10) Patent No.: US 7,846,276 B2
(45) Date of Patent: Dec. 7, 2010

(54) METHOD OF MAKING ALLOYS HAVING LOW COEFFICIENT OF THERMAL EXPANSION

(75) Inventors: David R. Hasek, Valencia, PA (US); Thomas R. Parayil, New Kensington, PA (US)

(73) Assignee: ATI Properties, Inc., Albany, OR (US)

( * ) Notice: Subject to any disclaimer, the term of this patent is extended or adjusted under 35 U.S.C. 154(b) by 497 days.

(21) Appl. No.: 11/742,732

(22) Filed: May 1, 2007

(65) Prior Publication Data

US 2007/0264150 A1 Nov. 15, 2007

Related U.S. Application Data

(63) Continuation of application No. 10/863,918, filed on Jun. 9, 2004, now abandoned.

(51) Int. Cl.
*C21D 7/02* (2006.01)
*C21D 8/02* (2006.01)

(52) U.S. Cl. ..... 148/645; 148/546; 148/547; 148/556; 148/621; 148/650; 148/651; 148/676; 148/677; 148/336

(58) Field of Classification Search ..... 148/546, 148/547, 621, 624, 651, 336, 556, 650, 676, 148/677; 420/94, 95, 97
See application file for complete search history.

(56) References Cited

U.S. PATENT DOCUMENTS 1,942,261 A 1/1934 Scott
4,751,424 A 6/1988 Tong
4,904,447 A 2/1990 Handa
5,234,512 A 8/1993 Inous et al.
5,476,633 A 12/1995 Sokolowski et al.
6,306,229 B1 * 10/2001 Ide et al. ..... 148/621
6,512,324 B1 * 1/2003 Makita et al. ..... 313/402
6,572,714 B1 * 6/2003 Kawahara et al. ..... 148/336
6,824,625 B2 11/2004 Fukuda et al.

OTHER PUBLICATIONS

Machine-English translation of Japanese patent 2002-275540, Isato Kita et al., Sep. 25, 2002.*
Allegheny Ludlum Technical Data Blue Sheet, Electrical Alloy AL36™ (Cryogenic & Bimetal), copyright 1998.
*A Hundred Years after the Discovery of Invar® . . . The Iron-Nickel Alloys* (Lavoisier Publishing 1996), p. 115.
Hamer, Leslie L., "After 100 Years, The Uses For Invar Continue To Multiply", (Jan. 1997), 7 pages. (printed from http://crswnew.cartech.com/wnew/techarticles/TA00008.html).
"The NILO® Nickel-Iron Alloys for Composite Tooling" (Inco Alloys International 1998), 11 pages.
"Alloy Data—Carpenter Super Invar 32-5", 5 pages. (printed on Feb. 29, 2004 from http://carpenter.idesinc.com/datasheet.asp?i=3&e=179&c=TechArt&VIEW=PRINTER).
Allegheny Ludlum Technical Data Blue Sheet, Electrical Alloy AL36™ (Cryogenic & Bimetal), copyright 1998.

(Continued)

*Primary Examiner*—Deborah Yee
(74) *Attorney, Agent, or Firm*—K & L Gates LLP; Patrick J. Viccaro; John E. Grosselin, III

(57) ABSTRACT

The present disclosure provides alloys having an ultra-low coefficient of thermal expansion in the range of 60° F. to 80° F. The alloys have coefficient of thermal expansion no greater than $0.35\times10^{-6}$° F.$^{-1}$ in the range of 60° F. to 80° F. Methods of making such alloys also are provided, as well articles of manufacture including such alloys and methods of making such articles.

21 Claims, 2 Drawing Sheets

OTHER PUBLICATIONS

*A Hundred Years after the Discovery of Invar® . . . The Iron-Nickel Alloys* (Lavoisier Publishing 1996), p. 115.

Hamer, Leslie L., "After 100 Years, The Uses For Invar Continue To Multiply", (Jan. 1997), 7 pages. (printed from http://crswnew.cartech.com/wnevv/techarticles/TA00008.html).

"The NILO® Nickel-Iron Alloys for Composite Tooling" (Inco Alloys International 1998), 11 pages.

"Alloy Data—Carpenter Super Invar 32-5", 5 pages. (printed on Feb. 29, 2004 from http://carpenter.idesinc.com/datasheet.asp?i=3&e=179&c=TechArt&VIEW=PRINTER).

ASTM Designation: F1684-96, "Standard Specification for Iron-Nickel and Iron-Nickel Cobalt Alloys for Low Thermal Expansion Applications", 6 pages, published Apr. 1996.

* cited by examiner

METHOD OF MAKING ALLOYS HAVING LOW COEFFICIENT OF THERMAL EXPANSION

CROSS-REFERENCE TO RELATED APPLICATIONS

The present application is a continuation application claiming priority under 35 U.S.C. from U.S. patent application Ser. No. 10/863,918 filed on Jun. 9, 2004 now abandoned.

BACKGROUND OF THE TECHNOLOGY

1. Field of Technology

The present invention relates to alloys having low coefficient of thermal expansion. The present invention more particularly relates to alloys including iron and/or nickel and having low coefficient of thermal expansion, to methods of making such alloys, and to article of manufacture including such alloys.

2. Description of the Background of the Technology

The propensity to expand and contract on changes in temperature is a fundamental property of metals and alloys. A material's coefficient of thermal expansion variously refers to a change in length, area, or volume as a function of change in the temperature of the material. As used in the present disclosure, the coefficient of thermal expansion or "CTE" of a material refers to the coefficient of linear thermal expansion "α", which satisfies the following equation I:

$$\Delta L/L_o = \alpha \Delta T \quad \text{(I)}$$

in which $L_o$ is the original length of the object of interest (in the measured direction), ΔT is the temperature change to which the object is subjected, and ΔL is the change in the object's measured length that occurs with the indicated change in temperature, expressed in the same units as $L_o$. Thus, $\Delta L/L_o$ is a fractional change in length, and the CTE is a material property that may differ depending on, for example, the nature of the material. Equation I indicates that the fractional change in length is proportional to the change in temperature and, in fact, that relationship only holds for most materials over relatively small temperature ranges. Because a material's CTE may depend on the particular temperature range in which the property is evaluated, it is often necessary to specify the temperature or temperature range when reporting the CTE of a material. Conventional analytical methods for determining CTE include measurements utilizing a dilatometer or laser interferometry.

Certain applications require low CTE metals and alloys, i.e., metals and alloys experiencing relatively little change in linear dimension with changes in temperature. In many such applications, the necessity for low CTE materials derives from the need to maintain substantially fixed distances between critical elements of an apparatus, the requirement for an element of substantially invariable length, or the need to maintain structural soundness of an assemblage of parts subjected to large variations in temperature. Applications requiring high dimensional stability with variation in temperature include structures for sophisticated telescopes and other optical devices; certain telecommunications equipment components, including filters in mobile phone networks; shadow masks, frames and gun parts used in cathode ray tubes; tank membranes for liquified natural gas tankers; mold plates for aircraft structural composite material fabrication; and bimetallic strips for thermostats and other applications.

A particularly well-known family of low CTE alloys is the family of alloys including about 36 weight percent nickel and the remainder of iron and allowable levels of incidental impurities. This family of nickel-iron alloys is sometimes referred to generically as the "Invar" family of alloys and is referred to herein as the "36Ni/Fe" alloys. When the 36Ni/Fe alloy family was discovered in 1896, the alloys' unique property of low linear expansion over a wide temperature range was initially employed to produce bimetals used in safety cut-off devices for gas stoves and heaters. For his work on nickel-iron systems and the discovery of the 36Ni/Fe alloys, Charles Edouard Guillaume was awarded the Nobel Prize for Physics in 1920. As shown in the FIG. 1, which plots CTE as a function of nickel content in a nickel-iron binary alloy, the 36Ni/Fe alloy having exactly 36 weight percent nickel has the lowest CTE. In fact, an alloy of 36 weight percent nickel and 64 weight percent iron is generally regarded as having the lowest CTE among all alloys in the range from room temperature (about 20° C.) up to approximately 230° C. In general, 36Ni/Fe alloys are ductile and easily weldable, and have machining characteristics similar to austenitic stainless steel.

ASTM Designation F 1684-99, "standard Specification for Iron-Nickel and Iron-Nickel-Cobalt Alloys for Low Thermal Expansion Applications", covers two common low thermal expansion 36Ni/Fe alloys, a "conventional" 36Ni/Fe alloy (designated UNS K93603) and a "free-machining" 36Ni/Fe alloy (designated UNS K93050). Each is nominally 36 weight percent nickel and 64 weight percent iron. Table 1 below provides the chemical requirements (in weight percentages) listed in ASTM F 1684 for these alloys. With one exception, these requirements relate to maximum allowable levels of various impurities, i.e., permissible deviation from the theoretical pure 36 weight percent nickel/64 weight percent iron alloy. The sole exception is with respect to selenium, which must be controlled to 0.15-0.30 weight percent in the free-machining alloy. Selenium is not measured (indicated as "NM") in the conventional alloy.

| Element | UNS K93603 | UNS K93050 |
|---|---|---|
| Iron, nominal | remainder | remainder |
| Nickel, nominal | 36 | 36 |
| Cobalt, max | 0.50 | 0.50 |
| Manganese, max | 0.60 | 1.00 |
| Silicon, max | 0.40 | 0.35 |
| Carbon, max | 0.05 | 0.15 |
| Aluminum, max | 0.10[a] | NM |
| Magnesium, max | 0.10[a] | NM |
| Zirconium, max | 0.10[a] | NM |
| Titanium, max | 0.10[a] | NM |
| Chromium, max | 0.25 | 0.25 |
| Selenium | NM | 0.15-0.30 |
| Phosphorus, max | 0.015[b] | 0.020 |
| Sulfur, max | 0.015[b] | 0.020 |

[a]The total of aluminum, magnesium, zirconium and titanium cannot exceed 0.20 weight percent.
[b]The total of phosphorus and sulfur cannot exceed 0.025 weight percent.

36Ni/Fe alloys are commercially available from various sources including Allegheny Ludlum Corporation, Pittsburgh, Pa., which distributes an AL 36™ electrical alloy for cryogenic (UNS K93603) and bimetal and trimetal (UNS 93603) applications having the following typical weight percentage chemistry: 36.00 nickel, 0.008 carbon, 0.30 manganese, 0.001 sulfur, 0.15 silicon, less than 0.35 cobalt, less than 0.02 molybdenum, less than 0.03 aluminum and balance iron.

36Ni/Fe alloys have CTE in the room temperature range that is less than 1 part per million per degree Fahrenheit, represented as "$<1\times10^{-6}$° F.$^{-1}$". This may be compared with the CTE of carbon steel at about $6.3\times10^{-6}$° F.$^{-1}$ and of aluminum at about $12.4\times10^{-6}$° F.$^{-1}$. However, although the "Invar" name was coined to allude to the alloy family's "invariable" expansion, the CTE of 36Ni/Fe alloys does vary depending on variations in composition and the temperature range in which CTE is measured. For example, the CTE of one 36Ni/Fe alloy is reported to be approximately $1.2\times10^{-6}$° C.$^{-1}$ in the range of −400° C. to 0° C.$^{-1}$ approximately $1.1\times10^{-6}$° C.$^{-1}$ in the range of −200° C. to 0° C., and approximately $0.5\text{-}1.1\times10^{-6}$° C.$^{-1}$ in the range of 25° C. to 93° C. In terms of the Celsius scale, the above CTE figures for 36Ni/Fe alloys may be compared with approximately $11\text{-}12\times10^{-6}$° C.$^{-1}$ for carbon steel, and approximately $22\text{-}24\times10^{-6}$° C. for aluminum.

Early applications of 36 Ni/Fe alloys included surveying tapes and wires, grandfather clock pendulums, glass sealing wires, and applications in light bulbs and electronic vacuum tubes for radios. The rate of new applications for the 36Ni/Fe alloys accelerated throughout the 20th century. Indeed, even after over 100 years since its discovery, the uses found for 36Ni/Fe alloys continue to multiply, and the alloys have recently been applied in fields as diverse as semiconductors, aerospace, television, information technology, and cryogenics. In the 1980's and 1990's it was discovered that 36 Ni/Fe alloys are particularly useful as lining material for tanks and containers used to ship liquified natural gas since the alloys' thermal expansion properties limit cryogenic shrinkage. More recently, 36 Ni/Fe alloys have been applied in shadow masks in high-definition cathode ray (television) tubes, as structural components in precision laser and optical systems, in wave guide tubes, in microscopes, as elements of support systems for large-mirror telescopes, in various other instruments requiring mounted lenses, as tight dimensional tolerance molds for curing advanced composites at moderately high temperatures, in orbiting satellites, in lasers, and as components of ring laser gyroscopes.

As applications requiring highly dimensionally stable materials become increasingly sophisticated, the requirements for minimum thermal expansion and contraction characteristics have become more demanding. Accordingly, there is a need to develop alloys having CTE's that are lower than existing 36 Ni/Fe alloys. There is a further need to develop alloys containing iron and/or nickel, such as, for example, alloys within the 36Ni/Fe alloy family, having CTE's that are lower than existing 36 Ni/Fe alloys.

SUMMARY

One aspect of the present disclosure addresses the need for improved low CTE alloys by providing alloys having CTE no greater than $0.35\times10^{-6}$° F.$^{-1}$ in the range of 60° F. to 80° F., at times referred to herein as "ultra-low CTE alloys". Embodiments of the ultra-low CTE alloys of the present disclosure have CTE less than $0.25\times10^{-6}$° F.$^{-1}$ in the range of 60° F. to 80° F., certain of those embodiments have CTE less than $0.20\times10^{-6}$° F.$^{-1}$ in the same temperature range, and certain of those embodiments have CTE less than $0.15\times10^{-6}$° F.$^{-1}$ in the same temperature range. Certain embodiments of the ultra-low CTE alloys of the present disclosure are temper rolled, while certain of such embodiments also are stretched. Certain embodiments of the ultra-low CTE alloys of the present disclosure include 35.5 to 36.5 weight percent nickel.

Another aspect of the present disclosure provides alloys including nickel and iron ("nickel/iron" alloys) having CTE no greater than $0.35\times10^{-6}$° F.$^{-1}$ in the range of 60° F. to 80° F. Certain embodiments of the ultra-low CTE iron/nickel alloys of the present disclosure have CTE less than $0.25\times10^{-6}$° F.$^{-1}$ in the range of 60° F. to 80° F., a subset of such alloys have CTE less than $0.20\times10^{-6}$° F.$^{-1}$, while a subset of those alloys have CTE less than $0.15\times10^{-6}$° F.$^{-1}$. In certain non-limiting embodiments, the ultra-low CTE nickel/iron alloys of the present disclosure consist essentially of iron, nickel and incidental impurities. Also, in certain non-limiting embodiments the ultra-low CTE nickel/iron alloys include 35.5 to 36.5 weight percent nickel and/or include about 36 weight percent nickel. Certain embodiments of the ultra-low CTE alloys of the present disclosure including about 36 weight percent nickel also include about 64 weight percent iron.

Yet another aspect of the present disclosure is directed to alloys having CTE no greater than $0.35\times10^{-6}$° F.$^{-1}$, less than $0.25\times10^{-6}$° F.$^{-1}$, less than $0.20\times10^{-6}$° F.$^{-1}$, or less than $0.15\times10^{-6}$° F.$^{-1}$, all measured in the range of 60° F. to 80° F.$^{-1}$, and wherein the alloys comprise, in weight percentages: 35.5 to 36.5 nickel; iron; 0 to 0.50 cobalt; 0 to 1.00 manganese; 0 to 0.40 silicon; 0 to 0.15 carbon; 0 to 0.25 chromium; 0 to 0.020 phosphorus; 0 to 0.020 sulfur; 0 to 0.30 selenium; 0 to 0.10 aluminum; 0 to 0.10 magnesium; 0 to 0.10 titanium; and 0 to 0.10 zirconium. Certain of these alloys also may have a composition within, for example, UNS K93603 and/or UNS K93050.

The present disclosure is further directed to certain alloys having CTE no greater than $0.35\times10^{-6}$° F.$^{-1}$, less than $0.25\times10^{-6}$° F.$^{-1}$, less than $0.20\times10^{-6}$° F.$^{-1}$, or less than $0.15\times10^{-6}$° F.$^{-1}$, all measured in the range of 60° F. to 80° F., and wherein the alloys consist essentially of, in weight percentages: 35.5 to 36.5 nickel; iron; 0 to 0.50 cobalt; 0 to 1.00 manganese; 0 to 0.40 silicon; 0 to 0.15 carbon; 0 to 0.25 chromium; 0 to 0.020 phosphorus; 0 to 0.020 sulfur; 0 to 0.30 selenium; 0 to 0.10 aluminum; 0 to 0.10 magnesium; 0 to 0.10 titanium; and 0 to 0.10 zirconium. Certain of these alloys also may have a composition within, for example, UNS K93603 and/or UNS K93050.

The present disclosure also addresses the above-described needs by providing certain novel methods of making ultra-low CTE alloys. One such method of the present disclosure comprises temper rolling a previously hot rolled alloy to a thickness reduction of at least 10%, wherein the resulting material has CTE no greater than $0.35\times10^{-6}$° F.$^{-1}$ in the range of 60° F. to 80° F. In certain of these embodiments, once subjected to the method of the present disclosure the alloy has CTE less than $0.25\times10^{-6}$° F.$^{-1}$, and in some cases less than $0.15\times10^{-6}$° F.$^{-1}$. In certain of the methods of the disclosure for making ultra-low CTE alloys, the previously hot rolled alloy is cold rolled to a reduction of at least 20%, while in certain of the methods the cold rolling reduction is at least 10% and no greater than 40%. In certain embodiments of the method of the present disclosure for making an ultra-low CTE alloy, the alloy is stretched subsequent to temper rolling (wherein "subsequent" means that the subject steps may occur one after the other or be spaced apart by intervening steps).

In certain embodiments of the methods of the present disclosure, the alloy consists essentially of iron, nickel and incidental impurities, while in other embodiments the alloy comprises 35.5 to 36.5 weight percent nickel and, in some cases, about 36 weight percent nickel. In yet other embodiments of the methods of the present disclosure, the alloy comprises, in weight percentages: 35.5 to 36.5 nickel; iron; 0 to 0.50 cobalt; 0 to 1.00 manganese; 0 to 0.40 silicon; 0 to 0.15 carbon; 0 to 0.25 chromium; 0 to 0.020 phosphorus; 0 to 0.020 sulfur; 0 to 0.30 selenium; 0 to 0.10 aluminum; 0 to 0.10 magnesium; 0 to 0.10 titanium; and 0 to 0.10 zirconium. Certain of these alloys also may have a composition within, for example, UNS K93603 and/or UNS K93050.

Yet other embodiments of the methods of the present disclosure involve alloys consisting essentially of, in weight percentages: 35.5 to 36.5 nickel; iron; 0 to 0.50 cobalt; 0 to 1.00 manganese; 0 to 0.40 silicon; 0 to 0.15 carbon; 0 to 0.25 chromium; 0 to 0.020 phosphorus; 0 to 0.020 sulfur; 0 to 0.30 selenium; 0 to 0.10 aluminum; 0 to 0.10 magnesium; 0 to 0.10 titanium; and 0 to 0.10 zirconium. Certain of these alloys also may have a composition within, for example, UNS K93603 and/or UNS K93050.

Yet another aspect of the present disclosure is directed to articles of manufacture comprising any of the ultra-low CTE alloys of the present disclosure, and to methods of making such articles of manufacture. Non-limiting examples of such articles of manufacture include a telescope, a camera, an optical device, a laser, a pipe, a cryogenic pipe, a telecommunications device, a mobile phone network filter, a cathode ray tube shadow mask part, a cathode ray tube frame part, a cathode ray tube gun part, a wave guide tube, a tank membrane, a tanker, a liquefied natural gas tanker, a mold plate for aircraft structural composite material fabrication, a bimetallic strip, a trimetallic strip and a thermostat.

The reader will appreciate the foregoing details as well as others, upon consideration of the following detailed description of certain non-limiting embodiments. The reader also may comprehend additional details of the present disclosure upon making and/or using the materials and/or methods set forth in the present disclosure.

DETAILED DESCRIPTION OF CERTAIN EMBODIMENTS

Figure 1:
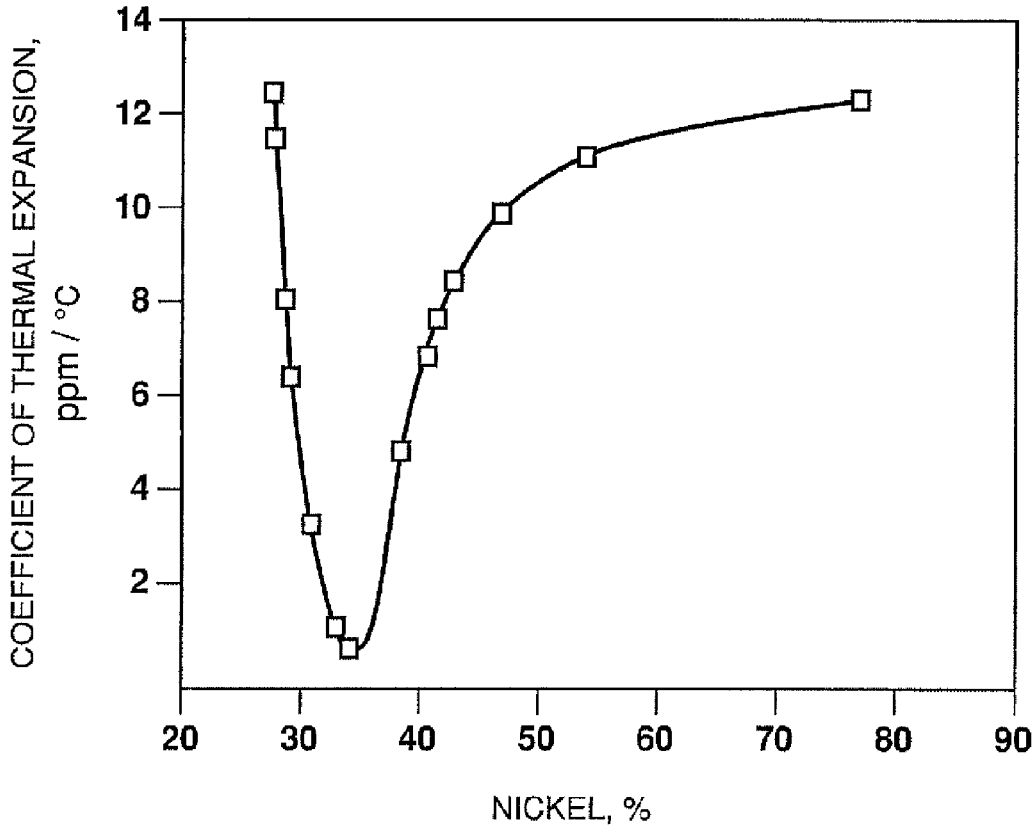
FIG. 1 is a graph showing the relationship between GTE and nickel content in a nickel-iron binary alloy in a particular temperature range.

Embodiments of the present invention relate to metal-containing alloys having low CTE, and particularly to those alloys having low CTE in the temperature range of 60° F. to 80° F. Certain non-limiting embodiments of the present utilize a 36Ni/Fe alloy as starting material and process the alloy by a method including a temper roll of at least 10% to substantially improve (reduce) CTE.

As used herein, "temper rolling" refers to a cold reduction process that is not followed by annealing. As is known in the art, and as described in the ASM Metals Handbook, annealing is a heat treatment designed to effect softening of a cold worked structure by recrystallization, grain growth, or both.

Reference herein to certain CTE parameters, such as a CTE limit, when evaluated within the range of 60° F. to 80° F. means that the stated CTE parameters are met when evaluated anywhere within the stated temperature range.

It is believed that the methods described herein may be applied to any iron and nickel containing alloy, such as the 36Ni/Fe alloys, for example, to reduce CTE. Other non-limiting examples of alloys including iron and nickel that may be treated using the methods of the present disclosure include alloys nominally including 42 weight percent nickel, balance iron and incidental impurities. Those of ordinary skill will readily recognize other iron and nickel containing alloys with which the methods of the present invention may be used in order to reduce GTE.

Certain of the 36Ni/Fe alloys include a nickel content of 35.5 to 36.5 weight percent, while certain of such alloys are nominally 36 weight percent nickel so as to minimize CTE. Such 36Ni/Fe alloys also will include varying levels of impurities incidental to the starting materials and the limitations of any refining steps applied during processing of the alloy. It is possible that minor amounts of intentionally added alloying elements may be present in order to enhance some property or properties of the material other than CTE. For example, as per ASTM F 1684-99, the free-machining alloy (UNS K93050) must include 0.15 to 0.30 weight percent selenium. After taking into account nickel, any minor intentional alloying additions, and allowable impurities, the remainder of the 36Ni/Fe alloy will be iron. Typically, the total content of elements other than nickel and iron within the alloy will be no more than about 2 weight percent. In those 36Ni/Fe alloys including 35.5 to 36.5 weight percent nickel and a maximum of 2 weight percent of elements other than nickel and iron, the iron content will be within the range of 61.5 to 64.5 weight percent.

Further taking into account the compositions set forth in ASTM F 1684-99 for the nominal 36 weight percent nickel/64 weight percent iron conventional (UNS K93603) and free-machining (UNS K93050) alloys, the concentrations of other elements within certain 36Ni/Fe alloys to which the method of the present invention may be applied are as provided in Table 2 below:

TABLE 2

| Element | Weight Percentage |
|---|---|
| Nickel | 35.5-36.5 |
| Cobalt | 0 to 0.50 |
| Manganese | 0 to 1.00 |
| Silicon | 0 to 0.40 |
| Carbon | 0 to 0.15 |
| Aluminum | 0 to 0.10 |
| Magnesium | 0 to 0.10 |
| Zirconium | 0 to 0.10 |
| Titanium | 0 to 0.10 |
| Chromium | 0 to 0.25 |
| Selenium | 0 to 0.30 |
| Phosphorus | 0 to 0.020 |
| Sulfur | 0 to 0.020 |

It is believed that adapting certain methods of the present disclosure to the production of a 36Ni/Fe alloy having an actual composition consisting solely of 36 weight percent nickel and 64 weight percent iron would provide the lowest known CTE for this material.

The inventors have discovered that material processed using methods within the present disclosure has ultra-low CTE, significantly below the CTE of certain conventionally processed 36Ni/Fe alloys, while maintaining satisfactory forming characteristics. More specifically, the inventors have determined that subjecting an annealed 36Ni/Fe alloy that is nominally 36 weight percent nickel and 64 weight percent iron to a temper rolling wherein the thickness reduction is at least 10%, and more preferably at least 20%, substantially reduces the CTE of the material. In addition, providing a stretching step subsequent to temper rolling further significantly reduces CTE. In certain CTE testing conducted in the range of 60 to 80° F., the reduction in CTE was from about $0.51\times10^{-6}$° $F.^{-1}$ for a conventionally processed 36Ni/Fe alloy to $0.35\times10^{-6}$° F. or less, and in some cases lower than $0.25\times10^{-6}$° $F.^{-}$, for the temper rolled material, and less than $0.25\times10^{-6}$° $F.^{-}$ for the temper rolled and stretched material. Though the reduced CTE values were considered to be stable in the evaluated range of 60° F. to 80° F., it may be desirable to stabilize the CTE using a stabilization heat treatment at, for example, 200° F.

Temper rolling is a typically a single-pass cold reduction step, and it is commonly applied to improve hardness or strength, and is particularly suitable as an alternative means to strengthen materials that do not suitably strengthen when heat treated. Certain non-limiting embodiments of the present disclosure are directed to methods including temper rolling cold reductions of at least 10%, preferably at least 20%, and up to 40% on cold rolled and annealed 36Fe/Ni alloys. As noted above, the temper rolled material may be stretched (i.e., deformed in tension) in a subsequent step to further reduce CTE, in some cases to less than $0.20\times10^{-6}$° F.$^{-}$.

Certain non-limiting embodiments of the invention of the present disclosure are illustrated in the following examples. It will be understood that the following examples are for purposes of illustrating only certain non-limiting embodiments of the present disclosure and do not represent the full range of application of the present invention, which is better indicated in the appended claims. For example, although the following examples utilize a particular 36Ni/Fe alloy, it will be understood that the method described herein may be applied to other alloys including nickel and iron, such as other 36Ni/Fe alloys and iron/nickel alloys including 36.5 to 36.5 weight percent nickel.

Example 1

A 36Ni/Fe alloy strip product was prepared as follows and evaluated for CTE and mechanical properties. The alloy comprised, in weight percentages: 36.09 nickel; 63.28 iron; 0.02 carbon; less than 0.01 cobalt; 0.40 manganese; 0.004 phosphorus; 0.002 sulfur; 0.05 silicon; less than 0.01 copper; less than 0.01 chromium; and 0.15 aluminum. The alloy was VIM melted, cast to a slab, and the slab was hot rolled to a 0.375-inch hot rolled plate. The hot rolled plate was then cold rolled to about 0.113 inch thickness, batch annealed and pickled. The material was then cold rolled to 0.090 inch, batch annealed, continuous annealed, and gas quenched. The quenched strip was then stretched 4% (i.e., deformed in tension so as to increase 4% in length). The average CTE of two test samples taken from the stretched material was $0.419\times10^{-6}$° F.$^{-1}$ in the 60° F. to 80° F. range.

A portion of the stretched material was stretched an additional 4% and evaluated for reduction in CTE. The average CTE in the 60° F. to 80° F. range of two samples from the "double-stretched" material was $0.35\times10^{-6}$° F.$^{-1}$. The CTE's of the single-stretched and double-stretched 36Ni/Fe alloy compare favorably with the GTE of $0.51\times10^{-6}$° F.$^{-1}$ CTE measured in the 60° F. to 80° F. range for the same alloy when processed in a conventional manner wherein the hot rolled alloy is cold rolled to final gauge, annealed and gas quenched.

Example 2

Figure 2:
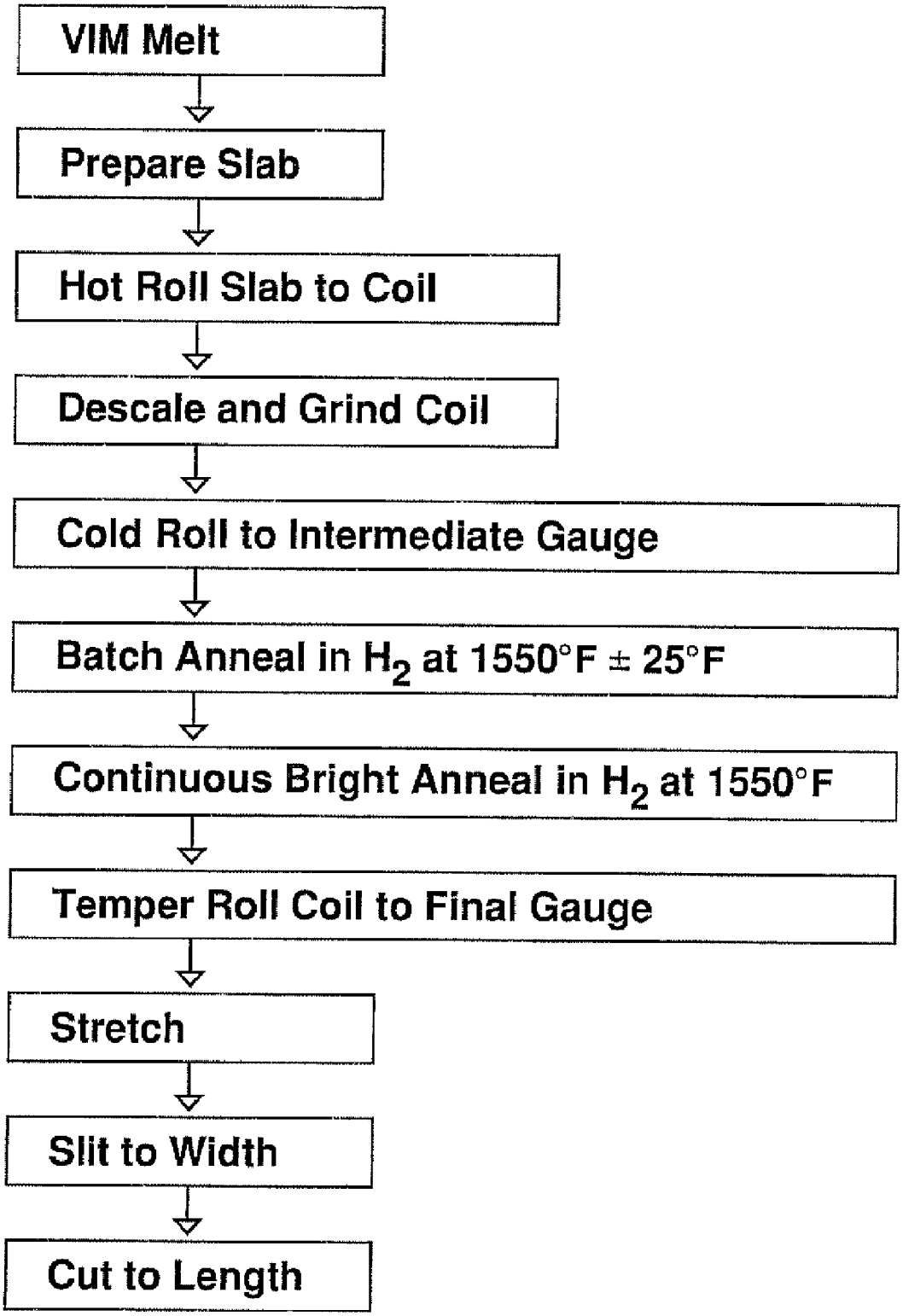
FIG. 2 is a diagram of a non-limiting embodiment of a method for processing a 36Ni/Fe alloy according to the present disclosure.

A 36Ni/Fe alloy having the composition of Example 1 was processed as generally shown in FIG. 2. The alloy was VIM melted and cast to a slab. The slab was hot rolled to a 0.375-inch hot rolled band, which was descaled and ground. The band was cold rolled in a first cold rolling stage to 0.150 inch, and in a second cold rolling stage to a 0.090 inch cold rolled strip. The cold rolled strip was annealed at a temperature in the range of 1500-1600° F. More specifically, the cold rolled strip was batch annealed in a hydrogen atmosphere at 1550° F.±25° F. for 2 hours, and then continuous bright annealed in a hydrogen atmosphere at 1550° F. with a fast cool. The annealed strip was then temper rolled on a two-roll rolling mill in a single pass to provide approximately 14% thickness reduction.

Samples of the temper rolled material were tested for CTE in the 60° F. to 80° F. range and for mechanical properties. The results are provided in Table 3 along with the results from Example 3 below. Each CTE listed in Table 3 is an average of the results of two tests, and all listed values for directional mechanical properties were evaluated in the longitudinal direction. "NM" indicates that a property was not determined. The temper rolled material's average CTE of $0.248\times10^{-6}$° F.$^{-1}$ is significantly less than the CTE of the single-stretched and double-stretched materials produced in Example 1 ($0.419\times10^{-6}$° F.$^{-1}$ and $0.35\times10^{-6}$° F.$^{-1}$, respectively) and is less than 50% of the CTE of the conventionally processed alloy ($0.51\times10^{-6}$° F.$^{-1}$).

TABLE 3

| Material | CTE ($10^{-6}$° F.$^{-1}$) | Modulus ($10^6$) | Microyield (psi) | Yield Point (psi) | Elongation (%) | UTS (psi) |
|---|---|---|---|---|---|---|
| Cold roll + anneal + 14% temper roll (Example 2) | 0.248 | 16.88 | 3180 | 59,052 | 18.2 | 61,480 |
| Cold roll + anneal + 20% temper roll (Example 2) | 0.1825 | 15.51 | 5654 | >60,000 | 8.5 | 59,040 |
| Cold roll + anneal + 14% temper roll + 2% stretch (Example 3) | 0.155 | 16.37 | 5094 | 61,260 | NM | NM |
| Cold roll + anneal + 20% temper roll + 2% stretch (Example 3) | 0.11 | 15.65 | 5005 | 61,040 | NM | NM |

As indicated in FIG. 2, the temper rolled material was further processed by stretching 2.0% and then re-evaluated for CTE and mechanical properties. (See FIG. 2.) As shown in Table 3, the 2% stretch unexpectedly significantly further reduced CTE of the temper rolled material to an average of $0.115\times10^{-6}$° F.$^{-1}$, or an approximately 40% reduction relative to the CTE of the temper rolled material. The CTE of the temper rolled and stretched material is less than 50% of the CTE of the double-stretched material produced in Example 1, and represents a 70% reduction relative to the $0.51\times10^{-6}$° F.$^{-1}$ CTE of the conventionally processed alloy noted in Example 1.

As indicated in FIG. 2, a production process including the foregoing steps in this Example 2 (and in Example 3) also may include the steps of slitting the stretched material to desired width, and then cutting the strip to desired length, Other possible processing steps will be apparent to those of ordinary skill upon considering the present disclosure.

Example 3

A 36Ni/Fe alloy having the composition of Example 1 was processed to a 0.113-inch cold rolled strip by the same sequence used in Example 2 and as shown in FIG. 2. The cold rolled strip also was batch annealed and continuous bright annealed under the conditions and for the times used in Example 2. The annealed, cold-rolled strip was then temper rolled on a two-roll rolling mill in a single pass to provide approximately 20% thickness reduction. CTE within the range of 60° F. to 80° F. and mechanical properties were evaluated in the manner of Example 2 and are provided in Table 3. The temper rolled material's average CTE of $0.1825\times10^{-6}$° F.$^{-1}$ is about ½ the CTE of the double-stretched material of Example 1 ($0.350\times10^{-6}$° F.$^{-1}$) and is less than 36% of the CTE of the conventionally processed material noted in Example 1 ($0.51\times10^{-6}$° F.$^{-1}$).

As shown in FIG. 2, the temper rolled material was stretched 2.0%, and the material was then evaluated for CTE and mechanical properties. As shown in Table 3, the stretching significantly reduced the CTE of the temper rolled material to an average of $0.11\times10^{-6}$° F.$^{-1}$, or an approximately 40% reduction relative to the CTE prior to stretching. The CTE of the temper rolled and stretched material is approximately 30% of the CTE of the double-stretched material produced in Example 1 ($0.350\times10^{-6}$° F.$^{-1}$), and represents a 78% reduction over the CTE of conventionally processed material noted in Example 1 ($0.51\times10^{-6}$° F.$^{-1}$).

Accordingly, the temper rolling of 36Ni/F alloys to reductions in excess of 10% significantly reduced CTE to values well below CTE of the same alloy subjected to either single or double stretching. Subjecting the alloy to a stretch subsequent to temper rolling unexpectedly further substantially reduced CTE of the material, to values less than ⅓ the CTE of samples of conventionally processed alloy.

The significant reduction in CTE achieved in the foregoing embodiments provides a material useful in applications requiring a material having ultra-low thermal expansion properties. The temper rolled and temper rolled/stretched material of the foregoing examples may be produced in conventional forms such as, for example, coiled strip and sheet. The material may then be formed into articles of manufacture or their component parts using conventional techniques known to those of ordinary skill and, in particular, having ordinary knowledge of techniques of fabricating articles of manufacture from 36Ni/Fe alloys and similar materials.

It will be understood that the present description illustrates those aspects relevant to a clear understanding of the invention. Certain aspects that would be apparent to those of ordinary skill in the art and that, therefore, would not facilitate a better understanding of the invention have not been presented in order to simplify the present description. Although embodiments of the present invention have been described, one of ordinary skill in the art will, upon considering the foregoing description, recognize that many modifications and variations of the invention may be employed. All such variations and modifications of the invention are intended to be covered by the foregoing description and the following claims.

We claim:

1. A method of making a material, the method comprising temper rolling an alloy comprising nickel and iron to a reduction of at least 10% and stretching the temper rolled alloy wherein stretching the temper rolled alloy increases a length by at least 2% to an effective length, wherein the resulting material has a coefficient of thermal expansion no greater than $0.35\times10^{6}$° F.$^{-1}$ in the range of 60 to 80° F.

2. The method of claim 1, wherein the method comprises temper rolling the alloy to a reduction of at least 20%.

3. The method of claim 1, wherein the method comprises temper rolling the alloy to a reduction of at least 10% and no greater than 40%.

4. The method of claim 1, wherein the resulting material has a coefficient of thermal expansion less than $0.25\times10^{-6}$° F.$^{-1}$ in the range of 60 to 80° F.

5. The method of claim 1, wherein the resulting material has a coefficient of thermal expansion less than $0.20\times10^{-6}$° F.$^{-1}$ in the range of 60 to 80° F.

6. The method of claim 1, wherein the alloy consists essentially of iron, nickel and incidental impurities.

7. The method of claim 1, wherein the alloy comprises 35.5 to 36.5 weight percent nickel.

8. The method of claim 1, wherein the alloy consists essentially of 35.5 to 36.5 weight percent nickel, iron, and incidental impurities.

9. The method of claim 1, wherein the alloy comprises about 36 weight percent nickel.

10. The method of claim 1, wherein the alloy comprises, in weight percentages: 35.5 to 36.5 nickel; iron; 0 to 0.50 cobalt; 0 to 1.00 manganese; 0 to 0.40 silicon; 0 to 0.15 carbon; 0 to 0.25 chromium; 0 to 0.020 phosphorus; 0 to 0.020 sulfur; 0 to 0.30 selenium; 0 to 0.10 aluminum; 0 to 0.10 magnesium; 0 to 0.10 titanium; and 0 to 0.10 zirconium.

11. The method of claim 1, wherein the alloy consists essentially of, in weight percentages: 35.5 to 36.5 nickel; iron; 0 to 0.50 cobalt; 0 to 1.00 manganese; 0 to 0.40 silicon; 0 to 0.15 carbon; 0 to 0.25 chromium; 0 to 0.020 phosphorus; 0 to 0.020 sulfur; 0 to 0.30 selenium; 0 to 0.10 aluminum; 0 to 0.10 magnesium; 0 to 0.10 titanium; and 0 to 0.10 zirconium.

12. The method of claim 11, wherein the material has a coefficient of thermal expansion less than $0.25\times10^{-6}$° F.$^{-1}$ in the range of 60 to 80° F.

13. The method of claim 1, wherein the alloy has a composition satisfying at least one of UNS K93603 and UNS K93050.

14. The method of claim 1 wherein the method further comprises, prior to temper rolling the alloy:

cold rolling the alloy; and annealing the alloy.

15. The method of claim 14, wherein annealing the alloy comprises heating the alloy at a temperature in the range of 1500° F. to 1600° F.

16. The method of claim 14, wherein annealing the alloy comprises heating the alloy at 1500° F.±25° F.

17. The method of claim 14, wherein annealing the alloy comprises heating the alloy at about 1500° F.

18. A method for making an article of manufacture, the method comprising:

providing a temper rolled and stretched of claim 1 material comprising 35.5 to 36.5 weight percent nickel and having a coefficient of thermal expansion no greater than $0.35\times10^{-6}$° F.$^{-1}$; and processing the material to form at least a part of the article of manufacture.

19. The method of claim 1, wherein stretching the temper rolled alloy increases the length by 4%.

20. The method of claim 1, wherein the method further comprises stretching at least a portion of the stretched, temper rolled alloy.

21. The method of claim 20, wherein stretching the stretched, temper rolled alloy increases the length by 4%.

* * * * *